US009393782B2

(12) United States Patent
Nagata

(10) Patent No.: US 9,393,782 B2
(45) Date of Patent: Jul. 19, 2016

(54) LIQUID DISCHARGE HEAD

(71) Applicant: CANON KABUSHIKI KAISHA, Tokyo (JP)

(72) Inventor: Shingo Nagata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/515,303

(22) Filed: Oct. 15, 2014

(65) Prior Publication Data

US 2015/0109369 A1 Apr. 23, 2015

(30) Foreign Application Priority Data

Oct. 17, 2013 (JP) ..... 2013-216415

(51) Int. Cl.
*B41J 2/14* (2006.01)

(52) U.S. Cl.
CPC ..... *B41J 2/14072* (2013.01); *B41J 2/14024* (2013.01)

(58) Field of Classification Search
CPC ..... B41J 2/14072; B41J 2/14024
USPC ..... 347/50, 58, 54, 63, 65
See application file for complete search history.

(56) References Cited

U.S. PATENT DOCUMENTS

2008/0024542 A1* 1/2008 Miyazaki ..... B41J 2/14072 347/20

FOREIGN PATENT DOCUMENTS

| | | | |
|---|---|---|---|
| JP | 2006-035854 | A | 2/2006 |
| JP | 2008-023962 | A | 2/2008 |
| JP | 2012-187804 | A | 10/2012 |

* cited by examiner

*Primary Examiner* — Henok Legesse
(74) *Attorney, Agent, or Firm* — Canon USA Inc. IP Division

(57) ABSTRACT

A liquid discharge head includes a substrate on the surface of which a liquid supply port opens, and a sealing material that is in contact with a side surface of the substrate and that seals the side surface of the substrate. On the surface of the substrate, an opening of the liquid supply port extends in a longitudinal direction. In a direction perpendicular to the longitudinal direction, the sealing material has a narrow region and a wide region. When the width of the narrow region is denoted as W1, and the width of the wide region is denoted as W2, W1<W2. The narrow region of the sealing material is formed in a position corresponding to the opening of the liquid supply port. In a direction parallel to the longitudinal direction, the length of the narrow region of the sealing material is less than the length of the opening of the liquid supply port.

19 Claims, 6 Drawing Sheets

LIQUID DISCHARGE HEAD

BACKGROUND OF THE INVENTION

1. Field of the Invention

The present invention relates to an liquid discharge head.

2. Description of the Related Art

A liquid discharge head used in a liquid discharge apparatus such as an inkjet recording apparatus has a support member and a recording element substrate. Examples of the support member include a tank case formed of resin and a plate formed of alumina. The recording element substrate is provided on the support member and has a substrate and a discharge port forming member.

It is known that the periphery of the discharge port forming member provided on the support member is sealed with sealing material. For example, when the recording element substrate is disposed in a recessed portion formed in the support member, the gap between the wall of the recessed portion and the recording element substrate is sealed with sealing material. As a result, the side surface of the recording element substrate is covered by the sealing material, and is protected from liquid.

When the periphery of the recording element substrate is sealed with sealing material, the sealing material contracts due to a change in ambient temperature or humidity, the contracting sealing material pulls the recording element substrate, and the recording element substrate may thereby be deformed.

Japanese Patent Laid-Open No. 2006-35854 describes forming a beam structure in a recording element substrate. If a beam structure is formed, the strength of the recording element substrate is improved, and deformation of the recording element substrate can be suppressed. As described in Japanese Patent Laid-Open No. 2012-187804, there is a method in which sides of a recording element substrate where electrical connection portions with an electrical wiring substrate are not present are not covered with sealing material and are exposed. By this method, deformation of the recording element substrate can also be suppressed.

Japanese Patent Laid-Open No. 2008-23962 describes forming a block on a plate forming a wall around a recording element substrate, and thereby reducing the amount of sealing material.

SUMMARY OF THE INVENTION

In an aspect of the present invention, a liquid discharge head includes a substrate on the surface of which a liquid supply port opens, and a sealing material that is in contact with a side surface of the substrate and that seals the side surface of the substrate. On the surface of the substrate, an opening of the liquid supply port extends in a longitudinal direction. In a direction perpendicular to the longitudinal direction, the sealing material has a narrow region and a wide region. When the width of the narrow region is denoted as W1, and the width of the wide region is denoted as W2, $W1<W2$. The narrow region of the sealing material is formed in a position corresponding to the opening of the liquid supply port. In a direction parallel to the longitudinal direction, the length of the narrow region of the sealing material is less than the length of the opening of the liquid supply port.

Further features of the present invention will become apparent from the following description of exemplary embodiments with reference to the attached drawings.

DESCRIPTION OF THE EMBODIMENTS

When a beam structure is formed as described in Japanese Patent Laid-Open No. 2006-35854, the manufacturing process is thereby complicated. The beam structure needs to withstand, for example, an impact applied during carriage scanning, and an impact applied due to a drop of the liquid discharge head or the inkjet recording apparatus, requires high dimensional accuracy, and is therefore difficult to manufacture.

In the case of the method described in Japanese Patent Laid-Open No. 2012-187804, since sides of a recording element substrate where electrical connection portions are not present are exposed, the substrate needs to be protected from liquid having a property that tends to corrode the substrate.

According to the method described in Japanese Patent Laid-Open No. 2008-23962, since the amount of sealing material decreases, deformation of the recording element substrate can be suppressed. However, the length of the block is larger than the supply port, and it is difficult to sufficiently seal the narrow space between the block and the recording element substrate with sealing material.

The present invention solves these problems and simply provides a liquid discharge head having a recording element substrate that is less likely to be deformed by contraction of sealing material sealing the periphery of the recording element substrate.

Embodiments of the present invention will be described with reference to the drawings.

Figure 1A:
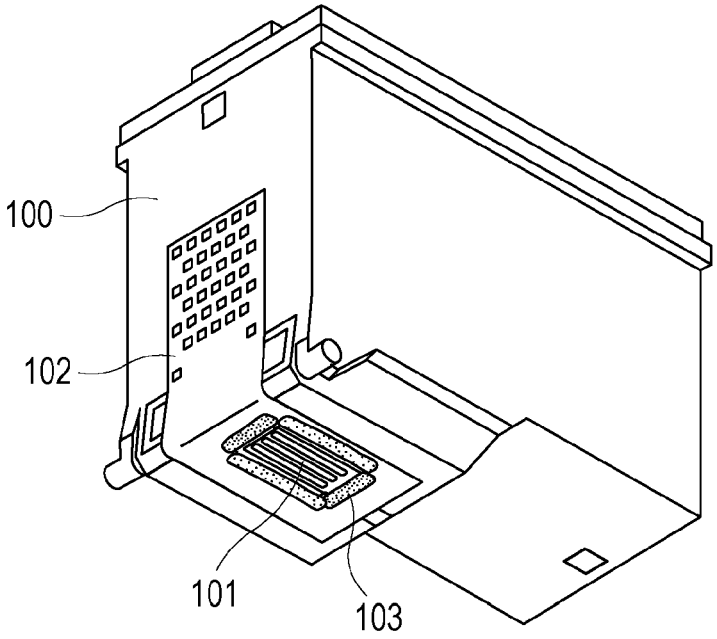
FIGS. 1A and 1B are diagrams showing an example of a liquid discharge head of the present invention.
Figure 1B:
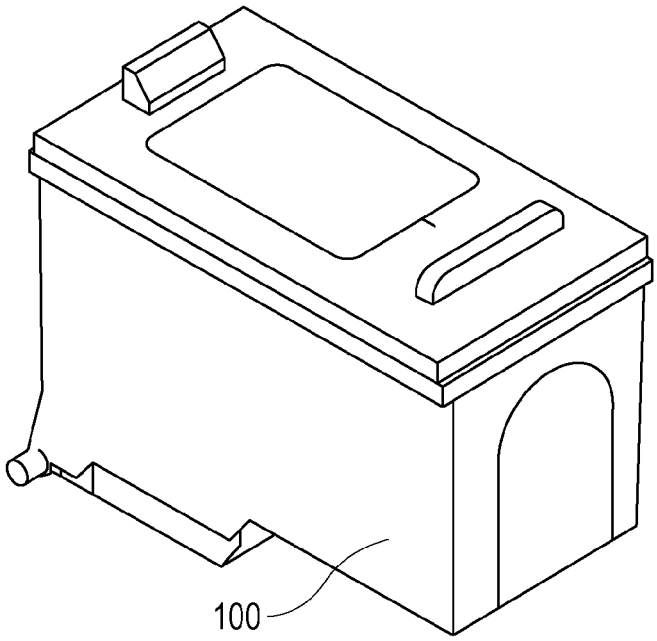

FIGS. 1A and 1B are perspective views showing an example of a liquid discharge head. FIGS. 1A and 1B are views of the liquid discharge head from different angles. The liquid discharge head has a tank case 100, a recording element substrate 101, and a tape-like electrical wiring substrate 102. The recording element substrate 101 is joined to the electrical wiring substrate 102. By bringing terminals provided on the electrical wiring substrate 102 into electrical contact with contact pins provided on a carriage mounted in a liquid discharge apparatus, an electrical signal is sent to energy generating elements, and recording operation is performed. Electrical connection portions between the recording element substrate 101 and the electrical wiring substrate 102 is covered and protected by lead sealing material 103. The lead sealing material 103 is provided so as to cover the periphery of the recording element substrate 101.

Figure 2:
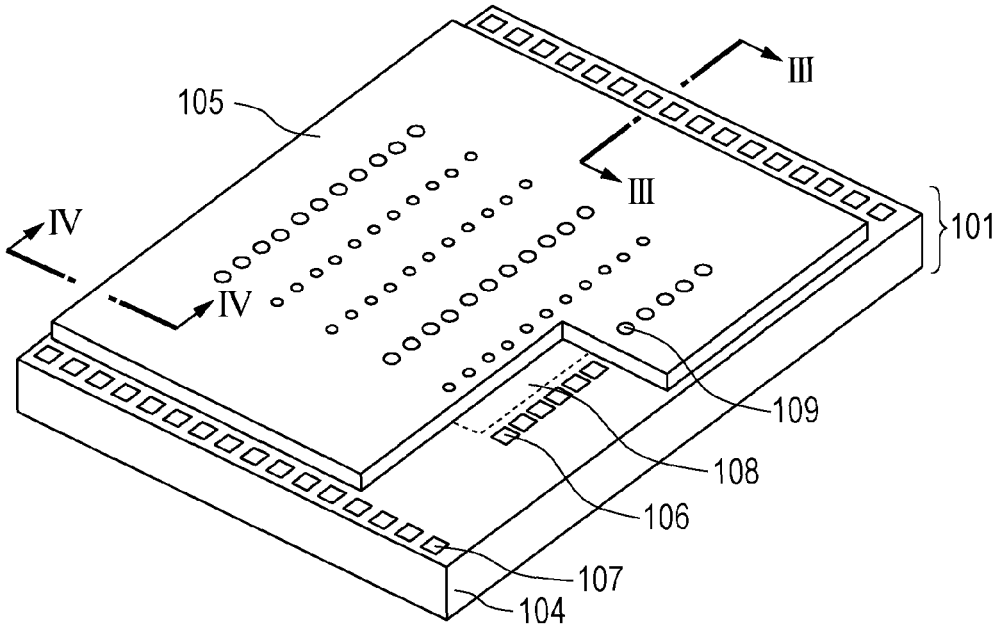
FIG. 2 is a diagram showing an example of a recording element substrate of a liquid discharge head of the present invention.

FIG. 2 is an enlarged view of the recording element substrate 101 shown in FIG. 1A. The recording element substrate 101 has a substrate 104 and a discharge port forming member 105. The substrate 104 is formed of silicon or the like. The discharge port forming member 105 is formed of resin, metal, silicon, or the like. Energy generating elements 106 that are electro-thermal transducers or piezoelectric transducers, electrical wiring (not shown) for sending an electrical signal to the energy generating elements 106, and electrical signal input terminals 107 for supplying power to the electrical wiring, and the like are formed on the substrate 104. Layers of gold are formed by plating on the surfaces of the electrical signal input terminals 107.

Liquid supply ports 108 are formed in the substrate 104, and the liquid supply ports 108 open on the surface of the substrate 104. On the surface of the substrate 104, the openings of the liquid supply ports 108 are like long grooves extending in the longitudinal direction. That is, the extending direction of the openings of the liquid supply ports 108 is the longitudinal direction of the openings of the liquid supply ports 108. The longitudinal direction of the liquid supply ports 108 is substantially parallel to the arranging direction of the liquid discharge ports 109 formed in the discharge port forming member 105. The liquid supply ports 108 supply liquid to liquid channels formed on the substrate. Energy generated from the energy generating elements 106 is imparted to the liquid supplied to the channels, and the liquid is discharged from the liquid discharge ports 109. In this way, the recording of an image is performed.

Figure 3:
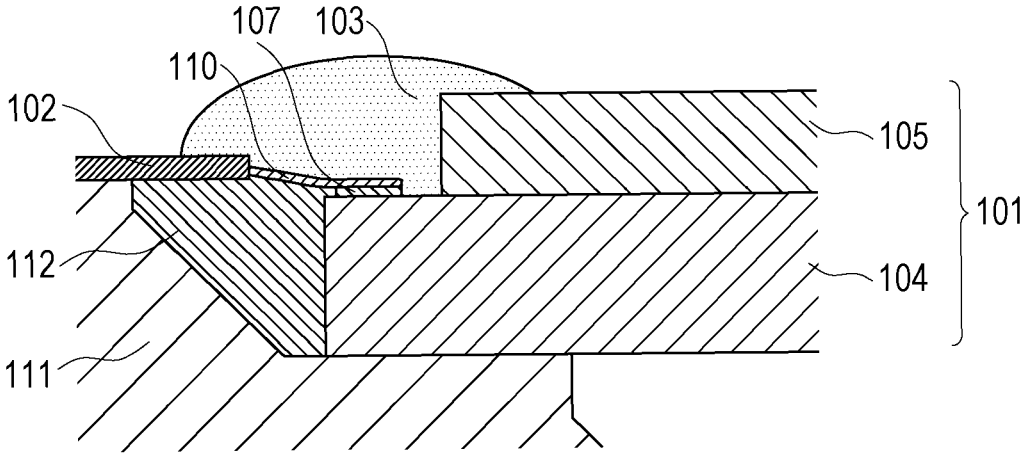
FIG. 3 is a diagram showing an example of a liquid discharge head of the present invention.

FIG. 3 is a diagram showing a section of the recording element substrate taken along line III-III of FIG. 2 together with sealing materials sealing the periphery of the recording element substrate and the support member. The recording element substrate 101 is formed on a support member 111. The support member 111 is formed of alumina or resin. FIG. 3 shows an example in which a tank case 100 formed of resin is used as the support member 111. The recording element substrate 101 and the electrical wiring substrate 102 are connected by thermal-pressure-bonding the layers of gold provided on the surfaces of the electrical signal input terminals 107 of the substrate 104 and the layers of gold provided on the surfaces of leads 110 extending from one end of the electrical wiring substrate 102. A wire bonding technique may also be used in which electrical signal input terminals 107 and connecting terminals of a flexible wiring substrate are connected via gold wires by thermal ultrasonic pressure bonding. The recording element substrate 101 and the electrical wiring substrate 102 bonded in this way are bonded to the support member 111 with adhesive (not shown).

In FIG. 3, a plurality of sealing materials are used. One of them is a sealing material 112 covering the side surface of the substrate 104. The sealing material 112 is in contact with the side surface of the substrate 104, and seals the side surface of the substrate 104. In FIG. 3, the recording element substrate 101 is disposed in a recessed portion of the support member 111, and the sealing material 112 seals this recessed portion.

The other sealing material is the lead sealing material 103 described above. The lead sealing material 103 seals the leads 110 and the discharge port forming member 105. As shown in FIG. 3, the leads 110 are sandwiched between the lower sealing material 112 and the upper lead sealing material 103. In this way, the leads are protected, and short circuit, corrosion, wire break, and the like are suppressed.

Figure 4:
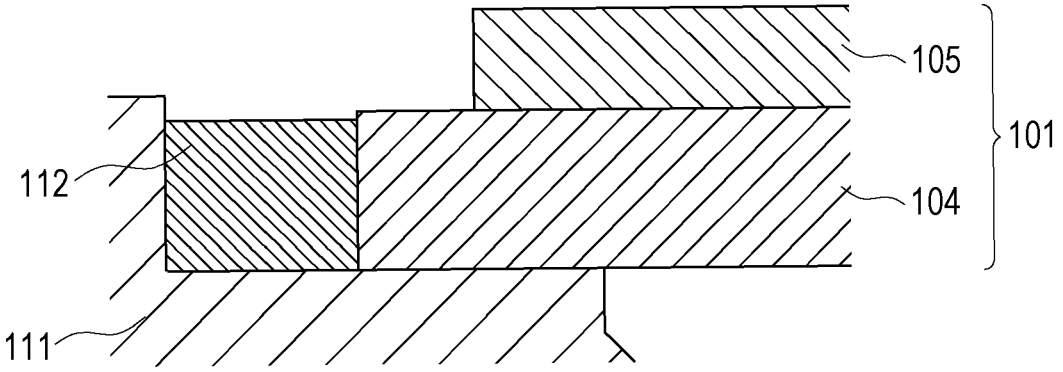
FIG. 4 is a diagram showing an example of a liquid discharge head of the present invention.

FIG. 4 is a diagram showing a section of the recording element substrate taken along line IV-IV of FIG. 2 together with the sealing material around the recording element substrate and the support member. In this part, the lead sealing material 103 and the leads 110 are not present. As described above, the recording element substrate 101 is disposed in the recessed portion of the support member 111, and the sealing material 112 seals this recessed portion. The sealing material 112 is in contact with the side surface of the substrate 104, and seals the side surface of the substrate 104.

Figure 5A:
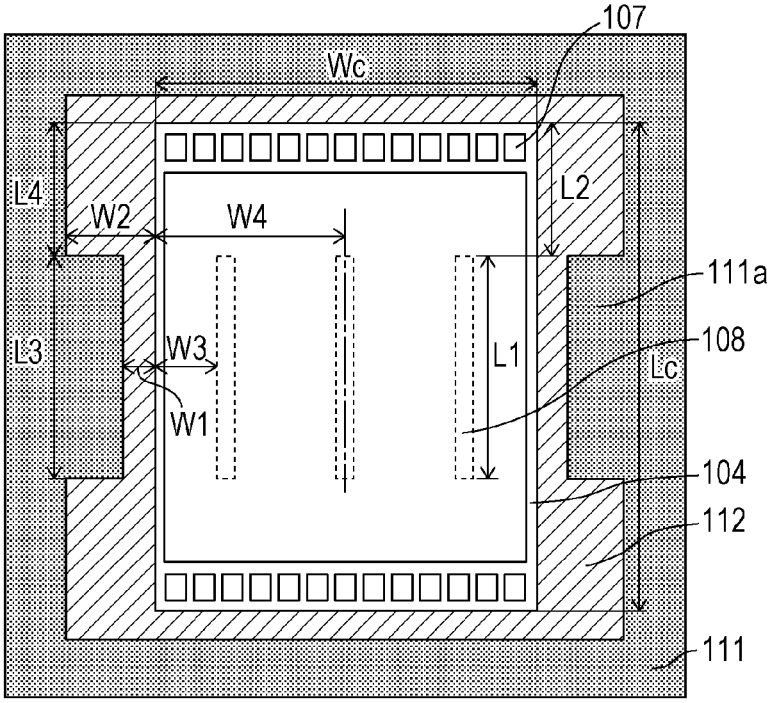
FIGS. 5A and 5B are diagrams showing an example of a liquid discharge head of the present invention.
Figure 5B:
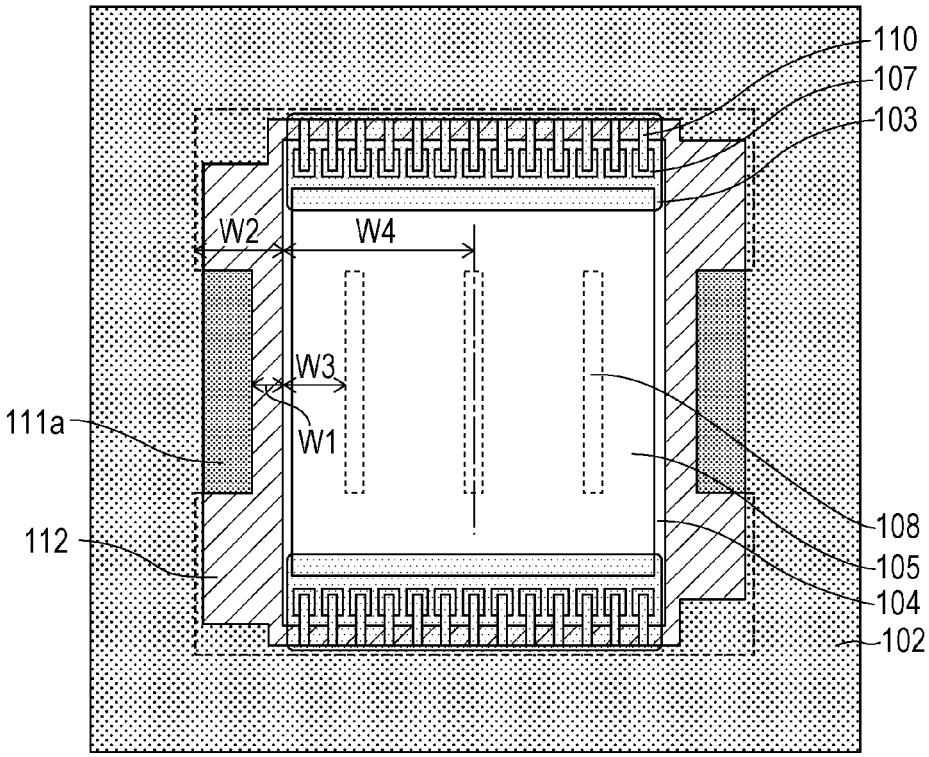

FIG. 5A is a view from above of the recording element substrate of the liquid discharge head. The recording element substrate is disposed in the recessed portion of the support member 111. The recording element substrate has the substrate and the discharge port forming member. FIG. 5A does not depict the discharge port forming member, and shows a state in which the substrate 104 and the liquid supply ports 108 that open on the substrate 104 are visible. The liquid supply ports 108 open in a rectangular shape, and extend in the longitudinal direction. Liquid discharge ports are formed on one or both sides of each liquid supply port 108 along the longitudinal direction of the liquid supply port 108. The support member 111 has a structure having protruding portions 111*a*. The protruding portions 111*a* have a shape protruding into the recessed portion. FIG. 5B shows a state in which the leads 110, lead sealing material 103, discharge port forming member 105, and electrical wiring substrate 102 are disposed on the liquid discharge head of FIG. 5A.

As shown in FIG. 5B, the sealing material 112 is disposed around the recording element substrate. The width of the sealing material 112 that is present in a direction perpendicular to the longitudinal direction of the liquid supply ports 108 varies from place to place. Specifically, as follows. In a direction perpendicular to the longitudinal direction of the liquid supply ports 108, the sealing material has narrow regions and wide regions. The width of the narrow regions is denoted as W1, and the width of the wide regions is denoted as W2. W1 and W2 are, for example, as shown in FIG. 5A. In this case, W1 and W2 are in a relationship of $W1<W2$. The narrow regions of the sealing material are formed in positions corresponding to the openings of the liquid supply ports.

The shape of the liquid supply ports 108 is not limited to a rectangular shape. The shape of the liquid supply ports 108 may be, for example, a trapezoidal shape, or such a shape that the opening width of the supply port is partially narrowed. In the cases of such shapes, the direction in which the liquid supply ports extend is referred to as longitudinal direction.

In a liquid discharge head in which the periphery of a recording element substrate is sealed with sealing material, the sealing material contracts due to a change in surrounding environment, specifically a change in temperature or humidity, and the recording element substrate is pulled and may be deformed. The inventors analyzed such a phenomenon in detail, and obtained the following knowledge.

The rigidity of the substrate 104 of the recording element substrate differs between a region in which the liquid supply ports 108 are formed and a region in which the liquid supply ports 108 are not formed. The rigidity K1 of the substrate 104 in the region in which the liquid supply ports 108 are formed is calculated by $K1=Ea\cdot Ta\cdot L1/W3$, where Ea is the elastic coefficient of the material forming the substrate (for example silicon), Ta is the thickness of the substrate, L1 is the length in the longitudinal direction of the liquid supply ports 108, and W3 is the shortest distance, in a direction perpendicular to the longitudinal direction of the liquid supply ports 108, from the end of the liquid supply port 108 to the end of the substrate 104. The rigidity K2 of the substrate 104 in the region in which the liquid supply ports 108 are not formed is calculated by $K2=Ea\cdot Ta\cdot L2/W4$, where L2 is the shortest distance, in the longitudinal direction of the liquid supply ports 108, from the end of the liquid supply port 108 to the end of the substrate 104, and W4 is the shortest distance, in a direction perpendicular to the longitudinal direction of the liquid supply ports 108, from the center of the substrate 104 to the end of the substrate 104. Since the sealing material 112 is present on both sides of the substrate 104, and the substrate 104 is pulled from both sides when the sealing material contracts, distance W4 is used for calculating rigidity K2. It is assumed that if a tensile force acts uniformly in a configuration in which the rigidity of substrate is partially different, distortion or the like occurs at the boundary between the high-rigidity part and the low-rigidity part, and leads to deformation of the substrate. If the tensile force exerted on the region in which the liquid supply ports are formed by the sealing material that is present in a direction perpendicular to the longitudinal direction of the liquid supply ports 108 is large, deformation of the substrate that starts from the liquid supply ports may occur.

In the light of the fact that the rigidity of the substrate is partially different due to the presence of the liquid supply ports, the inventors have found that by changing the tensile force according to the rigidity, distortion or the like at the boundary between the high-rigidity part and the low-rigidity part can be suppressed, and deformation of the substrate can be prevented. As a technique therefor, the width of the sealing material 112 that is present in a direction perpendicular to the longitudinal direction of the liquid supply ports 108 is varied from place to place. That is, as described above, the widths of the sealing material are in a relationship of W1<W2. In FIGS. 5A and 5B, the width of the sealing material 112 that seals the gap between the side wall of the substrate 104 and the wall of the support member is controlled by varying the shape of the recessed portion formed in the support member 111 by using the protruding portions 111*a* of the support member 111. The sealing material fills the gap between the recessed portion and the substrate. When the substrate 104 is viewed from a direction opposite to the surface of the substrate 104, the shortest distance between the side surface (the protruding end part) of the protruding portions 111*a* and the side surface of the substrate is W1, and the shortest distance between part of the side surface of the recessed portion where the protruding portions 111*a* are not formed and the side surface of the substrate is W2.

The tensile force S3 of the sealing material in contact with the end of the substrate in the region where the liquid supply ports 108 are formed is in a relationship of $S3 \propto Eb \cdot Tb \cdot L3/W1$, where Eb is the elastic coefficient of the sealing material 112, Tb is the thickness of the sealing material 112, and L3 is the length in the longitudinal direction of the sealing material in this region. In FIG. 5A, L3=L1. The tensile force S4 of the sealing material in contact with the end of the substrate in the region where the liquid supply port 108 are not formed is in a relationship of $S4 \propto Eb \cdot Tb \cdot L4/W2$, where L4 is the length in the longitudinal direction of the sealing material in this region. In FIG. 5A, L4=L2.

In this configuration, the ratio "S3/K1" of the rigidity of the substrate to the tensile force of the sealing material in the region where the rigidity of the substrate is low, that is, the region where the liquid supply ports are formed is $(Eb \cdot Tb/Ea \cdot Ta) \cdot (W3/W1)$. On the other hand, the ratio "S4/K2" of the rigidity of the substrate to the tensile force of the sealing material in the region where the rigidity of the substrate is high, that is, the region where the liquid supply ports are not formed is $(Eb \cdot Tb/Ea \cdot Ta) \cdot (W4/W2)$. The ratio of "S3/K1" to "S4/K2" is $W2 \cdot W3/W1 \cdot W4$. $W2 \cdot W3/W1 \cdot W4$ is preferably greater than or equal to 0.5 but less than or equal to 1.5 because the adjustment of tensile force according to the rigidity is appropriate. That is, W1, W2, W3, and W4 are set such that $W2 \cdot W3/W1 \cdot W4$ is within this range. $W2 \cdot W3/W1 \cdot W4$ is more preferably greater than or equal to 0.7, and is still more preferably greater than or equal to 0.9. $W2 \cdot W3/W1 \cdot W4$ is more preferably less than or equal to 1.3, and is still more preferably less than or equal to 1.1.

When reducing the amount of the sealing material (reducing the width of the sealing material), it is difficult to apply the sealing material to a region whose width is less than the diameter of a needle used for applying the sealing material. So, it is preferable to change the shape of the recessed portion by using the protruding portions 111*a* of the support member 111, and to thereby partially reduce the amount of the sealing material so that the relationship of the widths of the sealing material is W1<W2.

Next, a method for manufacturing the liquid discharge head of the present invention will be described with reference to FIGS. 6A to 6F.

Figure 6A:
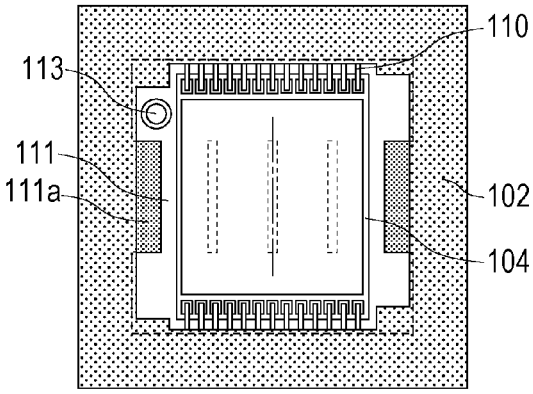
FIGS. 6A to 6F are diagrams showing an example of a method for manufacturing a liquid discharge head of the present invention.
Figure 6B:
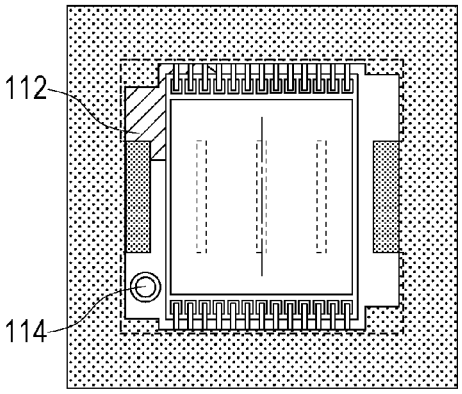

First, as shown in FIG. 6A, a support member 111 having a recessed portion in which a substrate 104 is disposed is prepared. Protruding portions 111*a* are formed so as to protrude into the recessed portion of the support member 111. The tip of a needle is set at an application starting position 113 in the recessed portion. Sealing material is discharged from the needle, and is poured into the recessed portion. In order to uniformize the thickness of the sealing material and to suppress the unevenness of the surface of the sealing material, the tip of the needle can be set at a position deeper (closer to the support member) than the surface of the substrate 104. By discharging sealing material 112 from the tip of the needle set at the application starting position 113, sealing of the periphery of the substrate 104 is started. If the needle can be inserted into the gap between the distal end of the protruding portion 111*a* and the substrate 104 (the position of W1 in FIGS. 5A and 5B), the tip of the needle is translated downward from the application starting position 113 while discharging sealing material. However, it may be difficult to insert the needle into this gap. In that case, as shown in FIG. 6B, after sealing material is discharged for a given length of time with the needle fixed at the application starting position 113, the tip of the needle is raised, and the tip of the needle is moved to an application starting position 114. From the application starting position 114, sealing material is discharged from the tip of the needle again. Thus, by utilizing the flowability of the sealing material 112, the sealing material 112 can be poured into the gap between the distal end of the protruding portion 111*a* and the substrate 104. The sealing material 112 can also be poured into the region below the leads 110 by utilizing the flowability of the sealing material 112. A method may also be used in which a multipoint discharge-type needle on which two needles are mounted are used, the needles are disposed on both sides of the substrate (the application starting position 113 and the application starting position 114), and sealing material is poured from both sides.

Figure 6C:
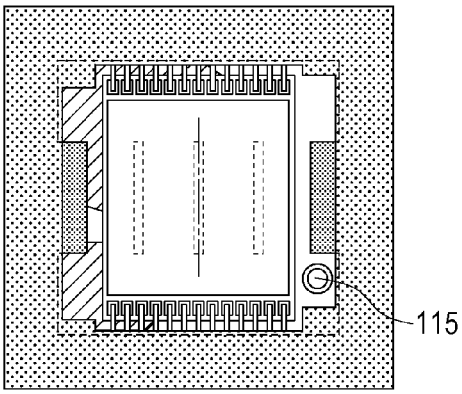
Figure 6D:
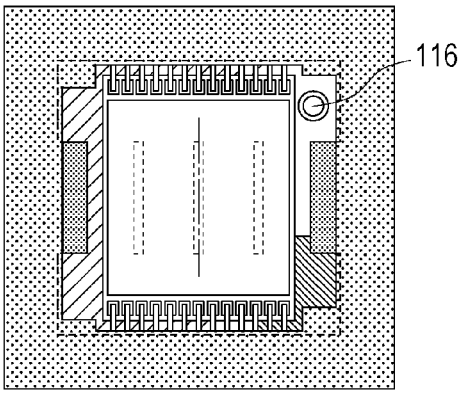

Next, as shown in FIG. 6C, the tip of the needle is set at an application starting position 115, and the sealing material 112 is discharged. Further, as shown in FIG. 6D, the tip of the needle is set at an application starting position 116, and the sealing material 112 is discharged. Thus, the periphery of the substrate 104 can be sealed with the sealing material 112. The sealing material 112 comes into contact with the bottom surface of the support member 111, the side surfaces of the protruding portions 111*a* of the support member 111, and the side surface of the substrate 104, and spreads over the entire recessed portion of the support member 111.

Figure 6E:
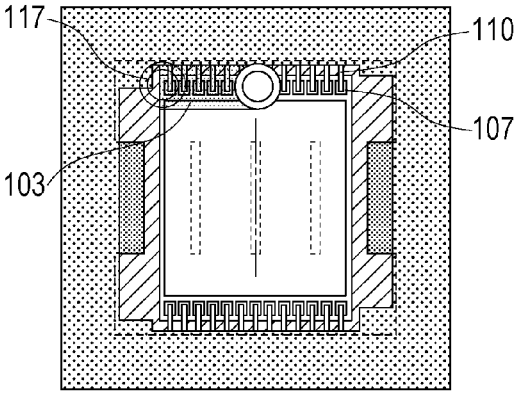
Figure 6F:
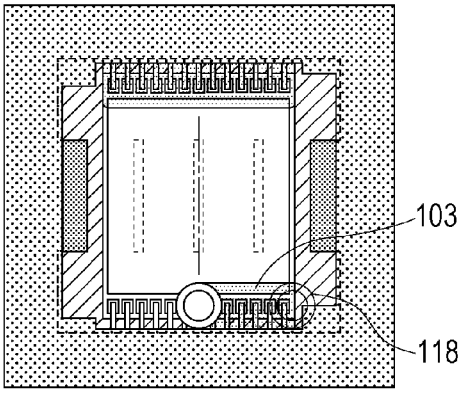

Next, as shown in FIG. 6E, the tip of the needle is set at an application starting position 117 that is one end of the row of electrical connection portions between the electrical signal input terminals 107 of the substrate 104 and the leads 110. Then, while discharging sealing material (lead sealing material) 103 from the tip of the needle set at the application starting position 117, the tip of the needle is moved in the arranging direction of the electrical signal input terminals 107. Thus, the lead sealing material 103 is applied on the leads 110, and the leads 110 are sealed. Similarly, as shown in FIG. 6F, sealing by the needle is performed from an application starting position 118. Thus, a liquid discharge head is manufactured.

The narrow regions of the sealing material can correspond to the liquid supply ports. However, the inflection point of stress can be displaced from the liquid supply ports. In this case, if the length of the narrow regions of the sealing material is increased so that, in a direction parallel to the longitudinal direction of the liquid supply ports, the length of the narrow regions of the sealing material is larger than the length of the opening of the liquid supply ports, it is difficult to sufficiently fill these narrow regions with the sealing material. So, in the present invention, in a direction parallel to the longitudinal direction of the liquid supply ports, the length of the narrow regions of the sealing material is less than or equal to the length of the opening of the liquid supply ports. In FIGS. 5A and 5B and FIGS. 6A to 6F, description has been given using an example in which, in a direction parallel to the longitudinal direction of the liquid supply ports, the length of the narrow regions of the sealing material is equal to the length of the opening of the liquid supply ports.

In FIG. 5B, the electrical wiring substrate 102 is formed on the support member. As shown in FIG. 5B, at least part of the protruding portions 111*a* can not be covered by the electrical wiring substrate 102. Thus, the electrical wiring substrate can be successfully formed while successfully suppressing the influence of protrusion of the sealing material.

Figure 7:
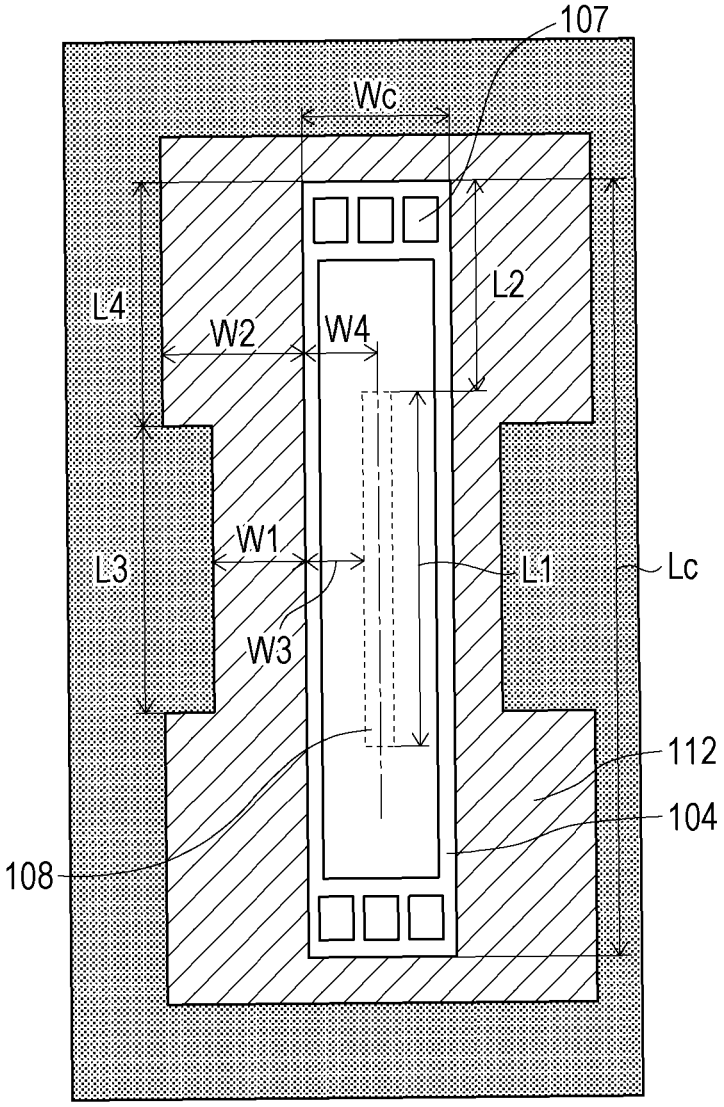
FIG. 7 is a diagram showing an example of a liquid discharge head of the present invention.

In FIGS. 5A and 5B and FIGS. 6A to 6F, description has been given using a recording element substrate in which a plurality of supply ports are formed. In the liquid discharge head of the present invention, the number of supply ports formed in the recording element substrate may be one. A recording element substrate in which one supply port is formed is shown in FIG. 7. In the liquid discharge head shown in FIG. 7, the width of the sealing material 112 varies from place to place. Specifically, as follows. In a direction perpendicular to the longitudinal direction of the liquid supply port 108, the sealing material has narrow regions and wide regions. The width of the narrow regions is denoted as W1, and the width of the wide regions is denoted as W2. In this case, W1 and W2 are in a relationship of W1<W2. The narrow regions of the sealing material are formed in positions corresponding to the openings of the liquid supply ports. In a direction parallel to the longitudinal direction of the liquid supply port, the length (L3) of the narrow regions of the sealing material is smaller than the length (L1) of the liquid supply port. Thus, deformation of the recording element substrate can be successfully suppressed.

EXAMPLES

The present invention will now be described more specifically with reference to examples.

Example 1

A liquid discharge head was manufactured by the method shown in FIGS. 6A to 6F.

First, as shown in FIG. 6A, a support member 111 having a recessed portion in which a substrate 104 was disposed was prepared. A silicon substrate formed of silicon was used as the substrate 104, and a tank case formed of resin (polypropylene) was used as the support member 111. Next, the tip of a needle was set at the application starting position 113 in the recessed portion of the support member 111. A needle having an inside diameter of 0.52 mm, an outside diameter of 0.82 mm, and a length of 8.00 mm was used. The tip of the needle was set at a position deeper than the surface of the substrate 104 by 0.30 mm. The needle was fixed at the application starting position 113, sealing material that is thermosetting epoxy resin is discharged from the needle, and filling of the recessed portion was started.

Next, the needle was raised, and the needle was moved to the application starting position 114 shown in FIG. 6B. The needle was set at the application starting position 114, and the sealing material was discharged from the tip of the needle again. As a result of these discharges, the sealing material 112 entered the gap between the distal end of the protruding portion 111*a* and the substrate 104, and came into contact with the distal end of the protruding portion 111*a* and the side surface of the substrate 104.

Next, as shown in FIG. 6C, the tip of the needle was set at the application starting position 115, and the sealing material 112 was discharged. Next, as shown in FIG. 6D, the tip of the needle was set at the application starting position 116, and the sealing material 112 was discharged. In these four discharges of the sealing material, the amount per discharge was about 6 mg. Thus, the periphery of the substrate 104 was sealed with the sealing material 112. Finally, the sealing material 112 spread over the entire recessed portion of the support member, and came into contact with the bottom surface of the support member 111, the side surfaces of the protruding portions 111*a* of the support member 111, and the side surface of the substrate 104.

Next, as shown in FIG. 6E, the tip of the needle was set at the application starting position 117 that is one end of the row of electrical connection portions between electrical signal input terminals 107 of the substrate 104 and leads 110. In this step, a needle having an inside diameter of 1.11 mm, an outside diameter of 1.49 mm, and a length of 8.00 mm was used. Next, sealing material that was thermosetting epoxy resin was discharged from the tip of the needle set at the application starting position 117. While discharging the lead sealing material 103, the tip of the needle was moved to the arranging direction of the electrical signal input terminals 107. Thus, the lead sealing material 103 was applied on the leads 110, and the leads 110 were sealed. Next, as shown in FIG. 6F, sealing of leads by the needle was performed from the application starting position 118 in the same manner. In these two discharges of sealing material, the amount per discharge was about 10 mg.

In this way, a liquid discharge head was manufactured. In the liquid discharge head manufactured in this example, Wc=3.4 mm, Lc=10.5 mm, W1=0.6 mm, W2=2.1 mm, L1=7.1 mm, L2=1.7 mm, W3=0.5 mm, W4=1.7 mm, L3=7.1 mm, and L4=1.7 mm. In the manufactured liquid discharge head, W1<W2, and $W2 \cdot W3/W1 \cdot W4 \approx 1.0$.

Example 2

The liquid discharge head shown in FIG. 7 was manufactured in the same way as in Example 1. In the manufactured liquid discharge head, Wc=0.6 mm, Lc=26.6 mm, W1=2.2 mm, W2=3.3 mm, L1=22.0 mm, L2=2.3 mm, W3=0.2 mm, W4=0.3 mm, L3=20.0 mm, and L4=3.3 mm. In the manufactured liquid discharge head, W1<W2, and $W2 \cdot W3/W1 \cdot W4 \approx 1.0$.

Example 3

A liquid discharge head of Example 3 was the same as the liquid discharge head of Example 1 except that W1=0.7 mm, and W2=1.5 mm. In the manufactured liquid discharge head, W1<W2, and W2·W3/W1·W4≈0.6.

Example 4

A liquid discharge head of Example 4 was the same as the liquid discharge head of Example 1 except that W1=0.6 mm, and W2=1.6 mm. In the manufactured liquid discharge head, W1<W2, and W2·W3/W1·W4≈0.8.

Example 5

A liquid discharge head of Example 5 was the same as the liquid discharge head of Example 1 except that W1=0.4 mm, and W2=1.8 mm. In the manufactured liquid discharge head, W1<W2, and W2·W3/W1·W4≈1.3.

Example 6

A liquid discharge head of Example 6 was the same as the liquid discharge head of Example 1 except that W1=0.4 mm, and W2=2.0 mm. In the manufactured liquid discharge head, W1<W2, and W2·W3/W1·W4≈1.4.

Comparative Example 1

A liquid discharge head of Comparative Example 1 was the same as the liquid discharge head of Example 1 except that W1=2.1 mm. That is, protruding portions 111*a* protruding into the recessed portion were not formed, and the width of sealing material on a line extended from the position where the liquid supply ports of the substrate are formed in a direction perpendicular to the longitudinal direction of the liquid supply ports was constant. In the manufactured liquid discharge head, W1=W2.

Comparative Example 2

A liquid discharge head of Comparative Example 2 was the same as the liquid discharge head of Example 1 except that W1=2.1 mm, and W2=1.0 mm. A method for manufacturing the liquid discharge head of Comparative Example 2 was the same as that of Example 1 except that sealing with sealing material was performed from the position of the width of W1. In the manufactured liquid discharge head, W1>W2.

EVALUATION

Thermal shock tests were conducted on the manufactured liquid discharge heads. The test condition was as follows. The liquid discharge heads were subjected to a cycle of temperature change of 0° C.→100° C.→0° C. (one hour). This was repeated for 200 cycles. After that, the electrical properties of the liquid discharge heads were measured. The liquid discharge heads were mounted in a liquid discharge recording apparatus, recording was performed on paper, and evaluation of image was performed. Further, the appearance of the liquid discharge heads was observed using a metallurgical microscope.

The liquid discharge heads of Examples 1 to 6 were excellent in both electrical property and image quality. As a result of observation of the appearance of the liquid discharge heads, no substrate breakage or the like was observed. In contrast, in the liquid discharge heads of Comparative Examples 1 and 2, slight deterioration in image quality occurred, and substrate breakage was observed.

The number of cycles was increased and evaluation was performed each time. First, in the liquid discharge heads of Examples 3 and 6, slight substrate breakage was observed. The number of cycles was further increased. In the liquid discharge heads of Examples 4 and 5, slight substrate breakage was observed. In contrast, in the liquid discharge heads of Examples 1 and 2, no substrate breakage or the like was observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-216415 filed Oct. 17, 2013, which is hereby incorporated by reference herein in its entirety.

What is claimed is:

1. A liquid discharge head comprising:

a substrate, on a surface of which a liquid supply port opens; and a sealing material that is in contact with a single side surface of the substrate extending in the longitudinal direction, wherein, the sealing material seals the single side surface of the substrate, wherein, the entire length of the sealing material that is in contact with the single side surface of the substrate extending in the longitudinal direction is denoted as Lc, wherein, on the surface of the substrate, an opening of the liquid supply port extends in the longitudinal direction, and the opening has a length denoted as L1, wherein, in a direction perpendicular to the longitudinal direction, the sealing material has a wide region being a widest region in the entire sealing material that is in contact with the single side surface of the substrate extending in the longitudinal direction, and a narrow region in the entire sealing material that is in contact with the single side surface of the substrate extending in the longitudinal direction, that is other than the widest region, wherein, when the width of the narrow region is denoted as W1, and the width of the wide region is denoted as W2, W1<W2, wherein, the narrow region is formed by a protruding portion that is substantially rectangular in the direction parallel to the longitudinal direction, wherein, when the total length of the narrow region is denoted as L3, and the total length of the wide region is denoted as L4×2, then L3+(L4×2)=Lc, and wherein, in a direction parallel to the longitudinal direction, L3<L1.

2. The liquid discharge head according to claim 1, wherein, when the shortest distance from the end of the liquid supply port to the end of the substrate in a direction perpendicular to the longitudinal direction of the liquid supply port is denoted as W3, and the shortest distance from the center of the substrate to the end of the substrate in the direction perpendicular to the longitudinal direction of the liquid supply port is denoted as W4, the W1, W2, W3, and W4 are values such that W2·W3/W1·W4 is greater than or equal to 0.5.

3. The liquid discharge head according to claim 2, wherein the W1, W2, W3, and W4 are values such that W2·W3/W1·W4 is greater than or equal to 0.7.

4. The liquid discharge head according to claim 2, wherein the W1, W2, W3, and W4 are values such that W2·W3/W1·W4 is greater than or equal to 0.9.

5. The liquid discharge head according to claim 2, wherein the W1, W2, W3, and W4 are values such that W2·W3/W1·W4 is less than or equal to 1.3.

6. The liquid discharge head according to claim 2, wherein the W1, W2, W3, and W4 are values such that W2·W3/W1·W4 is less than or equal to 1.1.

7. The liquid discharge head according to claim 2, wherein the substrate is disposed in a recessed portion of a support member, wherein a protruding portion protruding into the recessed portion is formed in the support member, and wherein, when the substrate is viewed from a direction opposite to the surface of the substrate, the shortest distance between the side surface of the protruding portion and the side surface of the substrate is the W1, and the shortest distance between part of the side surface of the recessed portion where the protruding portion is not formed and the side surface of the substrate is the W2.

8. The liquid discharge head according to claim 7, wherein the support member is formed of alumina or resin.

9. The liquid discharge head according to claim 7, wherein an electrical wiring substrate is formed on the support member, and at least part of the protruding portion is not covered by the electrical wiring substrate.

10. The liquid discharge head according to claim 1, wherein, when the shortest distance from the center of the substrate to the end of the substrate in a direction perpendicular to the longitudinal direction of the liquid supply port is denoted as W3, and the shortest distance from the end of the liquid supply port to the end of the substrate in the direction perpendicular to the longitudinal direction of the liquid supply port is denoted as W4, the W1, W2, W3, and W4 are values such that W2·W3/W1·W4 is less than or equal to 1.5.

11. The liquid discharge head according to claim 10, wherein the W1, W2, W3, and W4 are values such that W2·W3/W1·W4 is greater than or equal to 0.7.

12. The liquid discharge head according to claim 10, wherein the W1, W2, W3, and W4 are values such that W2·W3/W1·W4 is greater than or equal to 0.9.

13. The liquid discharge head according to claim 10, wherein the W1, W2, W3, and W4 are values such that W2·W3/W1·W4 is less than or equal to 1.3.

14. The liquid discharge head according to claim 10, wherein the W1, W2, W3, and W4 are values such that W2·W3/W1·W4 is less than or equal to 1.1.

15. The liquid discharge head according to claim 1, wherein the substrate is disposed in a recessed portion of a support member, wherein a protruding portion protruding into the recessed portion is formed in the support member, and wherein, when the substrate is viewed from a direction opposite to the surface of the substrate, the shortest distance between the side surface of the protruding portion and the side surface of the substrate is the W1, and the shortest distance between part of the side surface of the recessed portion where the protruding portion is not formed and the side surface of the substrate is the W2.

16. The liquid discharge head according to claim 15, wherein the support member is formed of alumina or resin.

17. The liquid discharge head according to claim 15, wherein an electrical wiring substrate is formed on the support member, and at least part of the protruding portion is not covered by the electrical wiring substrate.

18. The liquid discharge head according to claim 1, wherein the substrate is formed of silicon.

19. The liquid discharge head according to claim 1, wherein inflection points caused by the meeting of the narrow region with the wide region, are not located at ends of the opening of the liquid supply port, in the direction parallel to the longitudinal direction.

* * * * *